US009162742B2

(12) United States Patent
Tsutsui et al.

(10) Patent No.: US 9,162,742 B2
(45) Date of Patent: Oct. 20, 2015

(54) TRIM AND TILT APPARATUS FOR MARINE VESSEL PROPULSION MACHINE

(71) Applicant: SHOWA CORPORATION, Gyoda-shi (JP)

(72) Inventors: Hayato Tsutsui, Haga-gun (JP); Shinya Horie, Haga-gun (JP); Nobuaki Tanaka, Haga-gun (JP); Takeshi Ueki, Haga-gun (JP)

(73) Assignee: SHOWA CORPORATION, Gyoda-Shi (JP)

( * ) Notice: Subject to any disclaimer, the term of this patent is extended or adjusted under 35 U.S.C. 154(b) by 70 days.

(21) Appl. No.: 14/059,630

(22) Filed: Oct. 22, 2013

(65) Prior Publication Data

US 2014/0295719 A1 Oct. 2, 2014

(30) Foreign Application Priority Data

Mar. 27, 2013 (JP) ..... 2013-067451

(51) Int. Cl.
*B63H 20/10* (2006.01)

(52) U.S. Cl.
CPC ..... *B63H 20/10* (2013.01)

(58) Field of Classification Search
CPC ..... B63H 21/265; B63H 20/10; B63H 5/125; B63B 39/061
USPC ..... 440/61 D, 61 R, 61 S, 61 T
See application file for complete search history.

(56) References Cited

U.S. PATENT DOCUMENTS

| | | | | |
|---|---|---|---|---|
| 4,631,035 | A * | 12/1986 | Nakahama | 440/61 R |
| 5,007,866 | A * | 4/1991 | Okita | 440/61 R |
| 5,149,286 | A | 9/1992 | Tsujii | |
| 5,975,967 | A | 11/1999 | Nishi | |
| 7,241,194 | B2 * | 7/2007 | Tawa et al. | 440/61 S |
| 7,942,711 | B1 * | 5/2011 | Swan | 440/61 D |
| 2005/0282448 | A1 | 12/2005 | Tawa et al. | |

FOREIGN PATENT DOCUMENTS

| | | |
|---|---|---|
| JP | 2963611 B2 | 8/1999 |
| JP | 3905591 B2 | 1/2007 |
| JP | 4170960 B2 | 8/2008 |
| JP | 4206646 B2 | 10/2008 |

* cited by examiner

*Primary Examiner* — Lars A Olson
(74) *Attorney, Agent, or Firm* — Leason Ellis LLP

(57) ABSTRACT

A trim and tilt apparatus for a marine vessel propulsion machine includes: a cylinder having a cylinder chamber; a piston rod that is telescopically inserted into the cylinder chamber; and a hydraulic oil supply and discharge device that supplies and discharges hydraulic oil to and from the cylinder chamber, the trim and tilt apparatus allowing the marine vessel propulsion machine to perform a trim operation and a tilt operation, and the hydraulic oil supply and discharge device includes: a plurality of discharge units for simultaneously discharging the hydraulic oil; and a switching unit for switching between a case where the cylinder chamber is supplied with the hydraulic oil discharged by a part of the plurality of discharge units, and a case where the cylinder chamber is not supplied with the hydraulic oil discharged by the part of the plurality of discharge units.

12 Claims, 8 Drawing Sheets

TRIM AND TILT APPARATUS FOR MARINE VESSEL PROPULSION MACHINE

CROSS-REFERENCE TO RELATED PATENT APPLICATIONS

This application claims the benefit of priority to the Japanese Patent Application No. 2013-067451, filed on Mar. 27, 2013, the entire content of which is incorporated herein by reference.

BACKGROUND OF THE INVENTION

1. Field of the Invention

The present invention relates to a trim and tilt apparatus for a marine vessel propulsion machine.

2. Description of the Background Art Japanese Patent No. 2963511 describes a trim and tilt apparatus for a marine vessel propulsion machine which allows the marine vessel propulsion machine to perform a trim operation and a tilt operation. Specifically, the trim and tilt apparatus for the marine vessel propulsion machine described in Japanese Patent No. 2963511 includes a large-diameter cylinder and a small-diameter cylinder formed in series and in communication with each other. During a trim-up operation, hydraulic oil discharged by a pump is supplied to the large-diameter cylinder to push a large-diameter trim piston in the large-diameter cylinder up toward the small-diameter cylinder. During a tilt-up operation, after the trim piston reaches a maximum trim-up position, the hydraulic oil discharged by the pump is further fed to the large-diameter cylinder. The hydraulic oil then flows through a through-path provided in the trim piston and is filled into the small-diameter cylinder located below a tilt piston. The hydraulic oil thus moves only the tilt piston to a maximum tilt-up position.

[Patent Literature 1] Japanese Patent No. 2963511

The trim and tilt apparatus for the marine vessel propulsion machine described in Japanese Patent No. 2963511 has the following problems.

(1) During the tilt-up operation, the hydraulic oil discharged by only one pump is supplied to the small-diameter cylinder. This increases time needed to fill the small-diameter cylinder with the hydraulic oil and thus increases a tilt operation duration until the maximum tilt-up.

(2) At the end of the tilt-up operation, the pressure of the hydraulic oil acting to push the trim piston up toward the small-diameter cylinder is not applied. Thus, to retain the trim piston at a stroke end in a trim-up direction after the tilt-up operation ends, trim piston push-up means such as spring force or gravity is needed which constantly pushes up the trim piston toward the small-diameter cylinder.

An object of the present invention is to provide a trim and tilt apparatus for a marine vessel propulsion machine which serves to reduce the tilt-up operation duration until the maximum tilt-up and which allows the piston to be retained at the maximum tilt-up position at the end of the tilt-up operation without using the piston push-up means.

SUMMARY OF THE INVENTION

A first aspect of the invention is a trim and tilt apparatus for a marine vessel propulsion machine including a cylinder with one cylinder chamber, a piston rod that is telescopically inserted into the cylinder chamber of the cylinder, and a hydraulic oil supply and discharge device that supplies and discharges hydraulic oil to and from the cylinder chamber of the cylinder, the trim and tilt apparatus allowing the marine vessel propulsion machine to perform a trim operation and a tilt operation, wherein the hydraulic oil supply and discharge device includes a plurality of discharge units for simultaneously discharging the hydraulic oil, and has a switching unit for switching between a case where the cylinder chamber of the cylinder is supplied with the hydraulic oil discharged by a part of the plurality of discharge units, and a case where the cylinder chamber of the cylinder is not supplied with the hydraulic oil discharged by the part of the plurality of discharge units.

A second aspect of the invention is the invention of the first aspect wherein when a load greater than a weight of the marine vessel propulsion machine is applied to the piston rod, the switching unit avoids supplying the cylinder chamber of the cylinder with the hydraulic oil discharged by the part of the plurality of discharge units, and supplies the cylinder chamber of the cylinder with the hydraulic oil discharged by a remaining part of the plurality of discharge units, and when only the weight of the marine vessel propulsion machine is applied to the piston rod, the switching unit supplies the cylinder chamber of the cylinder with the hydraulic oil discharged by all of the plurality of discharge units.

A third aspect of the invention is the invention of the first aspect or the second aspect wherein the switching unit includes a relief valve that releases hydraulic oil of a specific pressure or higher which is discharged by the a part of the plurality of discharge units for simultaneously discharging the hydraulic oil that are provided in the hydraulic oil supply and discharge device.

A fourth aspect of the invention is the invention of any one of the first to third aspects wherein the hydraulic oil supply and discharge device includes a gear pump.

A fifth aspect of the invention is the invention of the fourth aspect wherein the gear pump has two driven gears that mesh with one drive gear.

(First Aspect)

(a) During the trim-up operation, the switching unit avoids supplying the cylinder chamber with the hydraulic oil discharged by a part of the plurality of discharge units of the hydraulic oil supply and discharge device, and supplies the cylinder chamber of the cylinder with the hydraulic oil discharged by a remaining part of the plurality of discharge units. On the other hand, during the tilt-up operation, the switching unit also supplies the cylinder chamber with the hydraulic oil discharged by the part of the plurality of discharge units of the hydraulic oil supply and discharge device, and as a result, supplies the cylinder chamber with the hydraulic oil discharged by all of the plurality of discharge units of the hydraulic oil supply and discharge device.

Thus, during the tilt-up operation, the cylinder chamber is supplied with the hydraulic oil discharged by all of the discharge units of the hydraulic oil supply and discharge device. This increases the flow rate of the hydraulic oil supplied to the cylinder chamber, with a resultant reduction in a tilt-up operation duration until the maximum tilt-up.

(b) Both the trim operation and the tilt operation are performed by moving only one piston of the piston rod through the cylinder chamber. The piston having reached the maximum tilt-up position under the pressure of the hydraulic oil discharged by the pump is retained at a stroke end in a tilt-up direction by the pressure of the hydraulic oil. Thus, at the end of tilt-up, the piston can be retained in a tilt-up state without using piston push-up means such as spring force or gravity.

(c) The aspects (a) and (b) can be achieved by the simple trim and tilt apparatus for the marine vessel propulsion machine including only one cylinder chamber and one piston.

(Second Aspect)

(d) During the trim-up operation, when the weight of and a forward propulsion by the marine vessel propulsion machine are applied to the piston rod, a load greater than the weight of the marine vessel propulsion machine is applied to the piston rod, and the cylinder chamber is not supplied with the hydraulic oil discharged by the part of the plurality of discharge units of the hydraulic oil supply and discharge device but only with the hydraulic oil discharged by the remaining part of the plurality of discharge units. On the other hand, during the tilt-up operation, when only the weight of the marine vessel propulsion machine is applied to the piston rod, the cylinder chamber is also supplied with the hydraulic oil discharged by the part of the plurality of discharge units of the hydraulic oil supply and discharge device, and as a result, the cylinder chamber is supplied with the hydraulic oil discharged by all of the plurality of discharge units of the hydraulic oil supply and discharge device.

(Third Aspect)

(e) The switching unit includes a relief valve that releases hydraulic oil of a specific pressure or higher which is discharged by a part of the plurality of discharge units for simultaneously discharging the hydraulic oil that are provided in the hydraulic oil supply and discharge device. This simplifies the switching unit.

(Fourth Aspect)

(f) The hydraulic oil supply and discharge device includes a gear pump. This allows the hydraulic oil supply and discharge device to be miniaturized.

(Fifth Aspect)

(g) The gear pump has two driven gears that mesh with one drive gear. Thus, the single gear pump allows the plurality of discharge units to be provided.

DESCRIPTION OF THE PREFERRED EMBODIMENT

Figure 1:
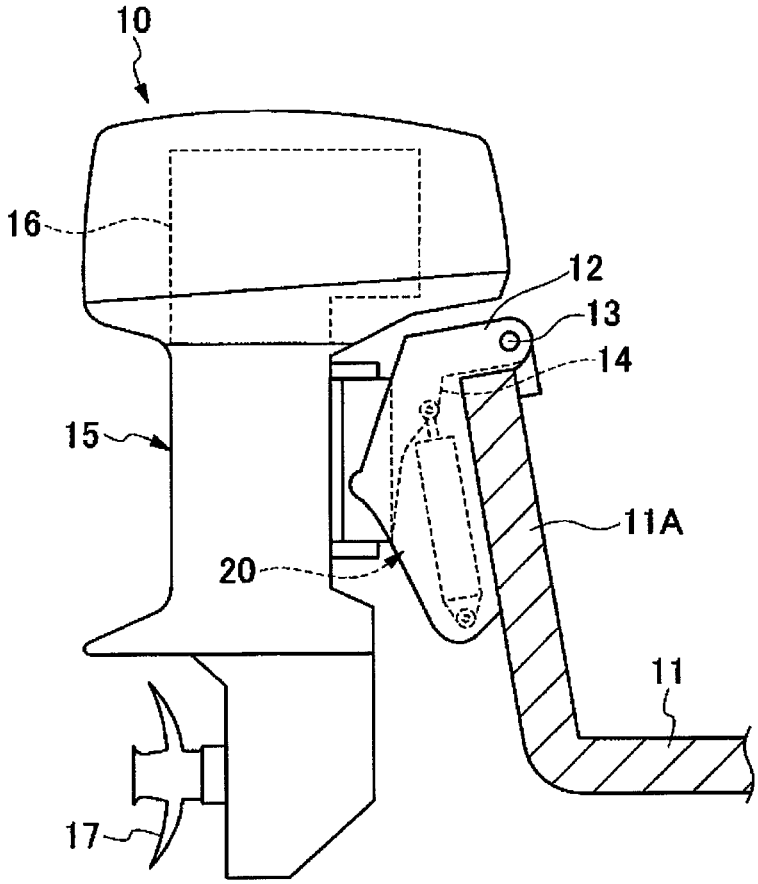
FIG. 1 is a schematic diagram showing a marine vessel propulsion machine.

As shown in FIG. 1, a marine vessel propulsion machine 10 (outboard drive type; however, the marine vessel propulsion machine 10 may be of an inboard engine outboard drive type) includes a clamp bracket 12 fixed to a 11A of a hull 11. A swivel bracket 14 is pivotally attached to the clamp bracket 12 via a tilt shaft 13 so as to be tiltable substantially around a horizontal shaft. A propulsion unit 15 is pivotally attached to the swivel bracket 14 via a turning shaft (not shown in the drawings) disposed substantially in a vertical direction, so as to move rotationally around the turning shaft. An engine unit 16 is mounted above the propulsion unit 15, and a propeller 17 is provided below the propulsion unit 15.

That is, in the marine vessel propulsion machine 10, the propulsion unit 15 is supported by the clamp bracket 12 fixed to the hull 11, via the tilt shaft 13 and the swivel bracket 14 in a tiltable manner. A cylinder device 21 of a trim and tilt apparatus 20 is interposed between the clamp bracket 12 and the swivel bracket 14. A hydraulic oil supply and discharge device 22 supplies and discharges hydraulic oil to and from the cylinder device 21 in a controllable manner to extend and contract the cylinder device 21, thus allowing the propulsion unit 15 to tilt within a trim range or a tilt range. The marine vessel propulsion machine 10 holds the propulsion unit 15 in a relatively gently tilted state within the trim range to enable a sailing orientation optimum for changes in water surface load to be achieved.

(Cylinder device 21)

Figure 2:
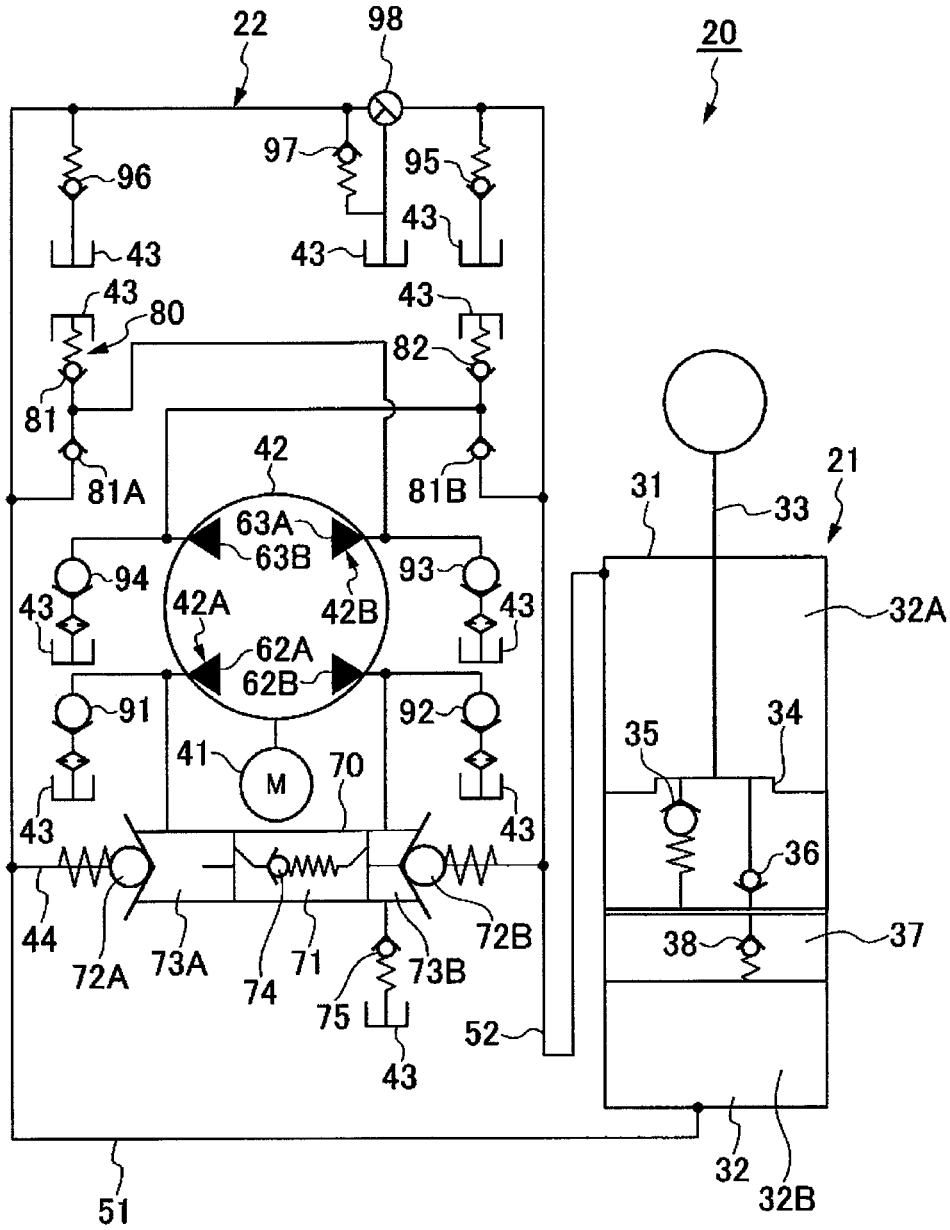
FIG. 2 is a circuit diagram showing a trim and tilt apparatus for the marine vessel propulsion machine.

As shown in FIG. 2, the cylinder device 21 of the trim and tilt apparatus 20 has a cylinder 31 connected to the clamp bracket 12. A cylinder chamber 32 is formed in the cylinder 31.

Furthermore, the cylinder device 21 has a piston rod 33 connected to the swivel bracket 14. A piston 34 in the piston rod 33 is slidably interposed in the cylinder chamber 32 shaped like a straight cylinder extending so as to have the same cross-sectional area in an axial direction of the cylinder chamber 32. The piston 34 partitions the cylinder chamber 32 into a first cylinder chamber 32A that accommodates the piston rod 33 and a second cylinder chamber 32B that does not accommodate the piston rod 33. An absorber valve and a check valve provided in the piston 34 are denoted by 35 and 36, and a free piston with a check valve 38 is denoted by 37.

(Hydraulic Oil Supply and Discharge Device 22)

The hydraulic oil supply and discharge device 22 includes a reversible motor 41, a reversible gear pump 42, a tank 43, and a channel 44 with a selector valve to enable hydraulic oil to be supplied to and discharged from the first cylinder chamber 32A and second cylinder chamber 32B of the cylinder device 21 via a first channel 51 and a second channel 52.

Figure 3:
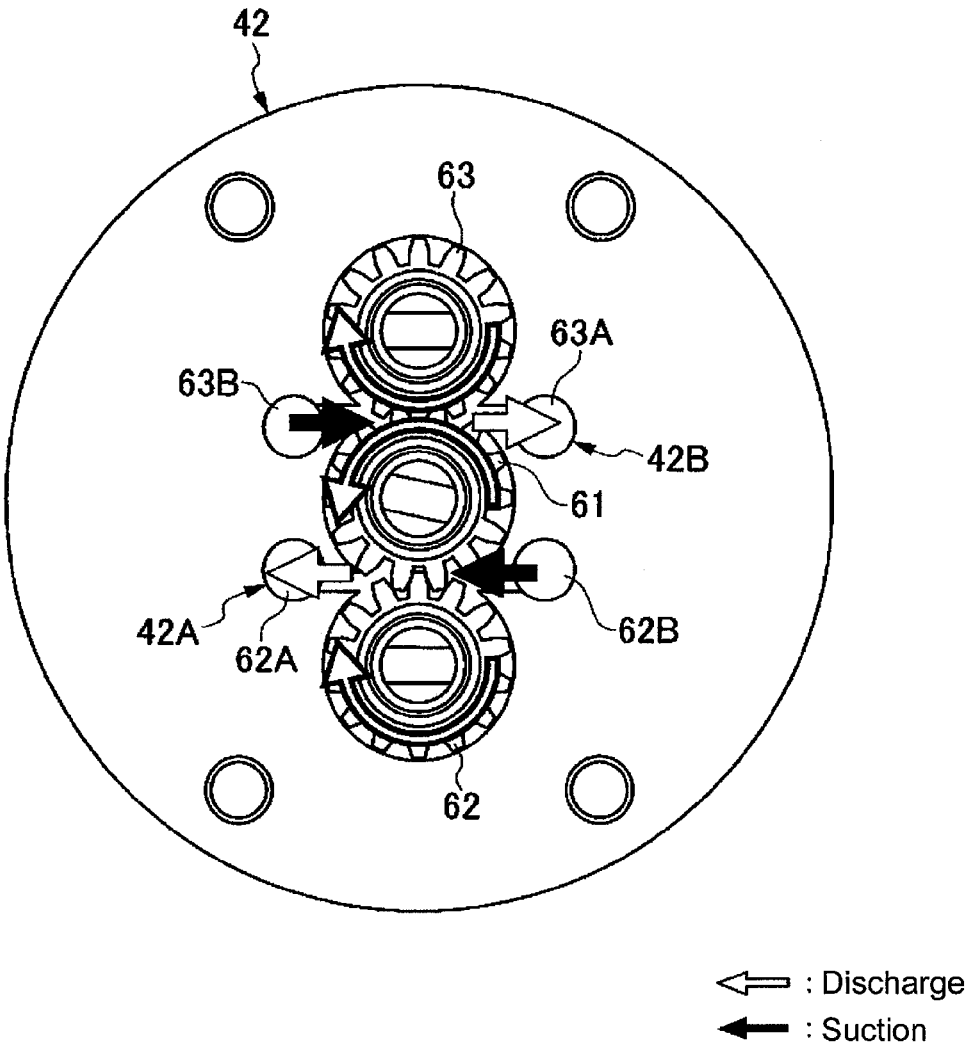
FIG. 3 is a schematic diagram showing a normal rotation state of a gear pump.
Figure 4:
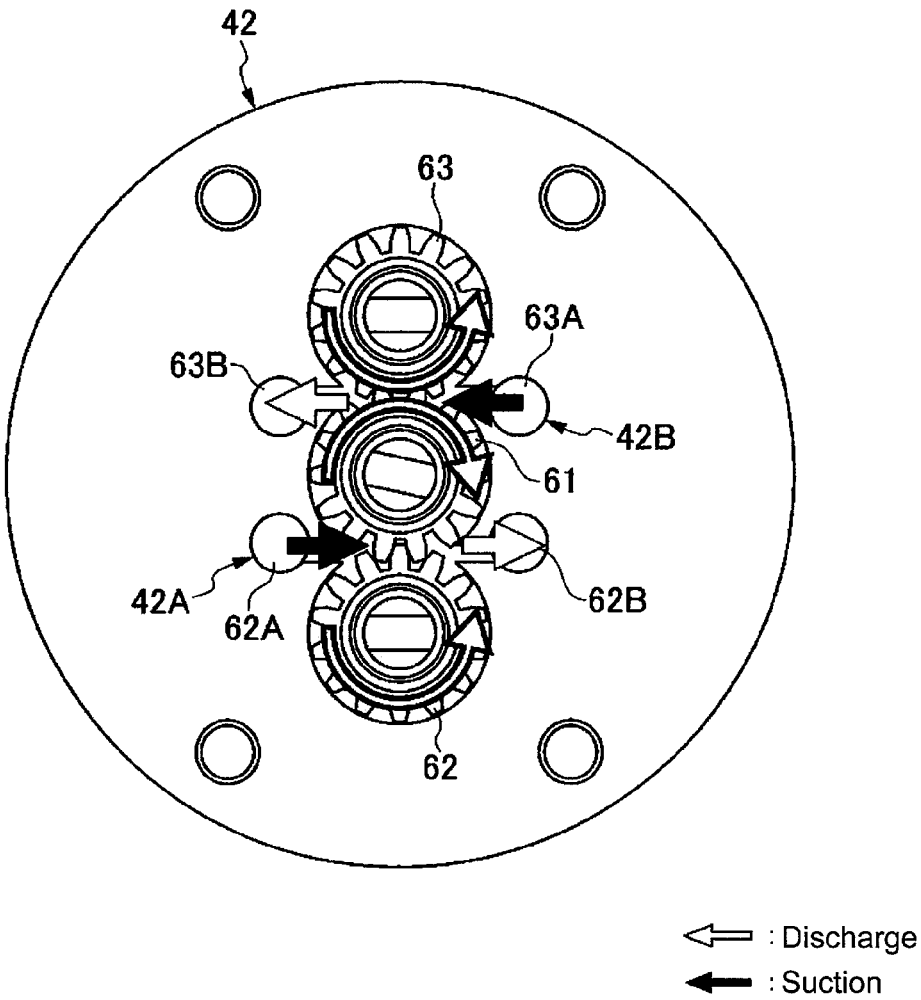
FIG. 4 is a schematic diagram showing a reverse rotation state of the gear pump.

As shown in FIG. 3 and FIG. 4, the gear pump 42 has one drive gear 61 and two driven gears 62 and 63 that mesh with the drive gear 61 and includes the first discharge unit 42A with the drive gear 61 and the driven gear 62 and the second discharge unit 42B with the drive gear 61 and the driven gear 63. The gear pump 42 includes ports 62A and 62B on the opposite sides of the first discharge unit 42A including a meshing portion between the drive gear 61 and the driven gear 62, and ports 63A and 63B on the opposite sides of the second discharge unit 42B including a meshing portion between the drive gear 61 and the driven gear 63. When the gear pump 42 is rotated normally by the motor 41 (FIG. 3), the port 62A and the port 63A serve as discharge ports, whereas the port 62B and the port 63B serve as suction ports. When the gear pump 42 is rotated reversely by the motor 41 (FIG. 4), the port 62B and the port 63B serve as discharge ports, whereas the port 62A and the port 63A serve as suction ports. Thus, during the normal rotation, the gear pump 42 simultaneously discharges hydraulic oil through the ports 62A and 63A of the two discharge units 42A and 42B. During the reverse rotation, the gear pump 42 simultaneously discharges hydraulic oil through the ports 62B and 63B of the two discharge units 42A and 42B.

In FIG. 3 and FIG. 4, blank arrows show flows of discharged oil, and filled arrows show flows of sucked oil.

The port 62A of the gear pump 42 is in communication with the first channel 51 via a shuttle selector valve 70. The port 62B of the gear pump 42 is in communication with the second channel 52 via the shuttle selector valve 70. The shuttle selector valve 70 has a shuttle piston 71, a first check valve 72A and a second check valve 72B located on the opposite sides of the shuttle piston 71, a first shuttle chamber 73A defined on the first check valve 72A side of the shuttle piston 71, and a second shuttle chamber 73B defined on the second check valve 72B side of the shuttle piston 71.

A trim-up operation and a tilt-up operation are performed as follows. The gear pump 42 rotates normally to discharge hydraulic oil through the port 62A. The hydraulic oil flows to the first shuttle chamber 73A to open the first check valve 72A. The hydraulic oil is then fed to the second cylinder chamber 32B of the cylinder device 21 via the first channel 51 to extend the cylinder device 21. A tilt-down operation and a trim-down operation are performed as follows. The gear pump 42 rotates reversely to discharge hydraulic oil through the port 62B. The hydraulic oil flows to the second shuttle chamber 73B to open the second check valve 72B. The hydraulic oil is then fed to the first cylinder chamber 32A of the cylinder device 21 via the second channel 52 to contract the cylinder device 21. In these cases, the shuttle piston 71 is moved by the above-described oil feeding pressure resulting from the normal rotation of the gear pump 42 to open the second check valve 72B, allowing the hydraulic oil discharged from the first cylinder chamber 32A of the cylinder device 21 to be sucked into the port 62B via the second channel 52. Furthermore, the shuttle piston 71 is moved by the above-described oil feeding pressure resulting from the reverse rotation of the gear pump 42 to open the second check valve 72B, allowing the hydraulic oil discharged from the second cylinder chamber 32B of the cylinder device 21 to be sucked into the port 62A via the first channel 51.

The shuttle piston 71 of the shuttle selector valve 70 includes a built-in extension side relief valve 74. During the tilt-up operation, the extension side relief valve 74 releases the hydraulic oil pumped through the port 62A by the gear pump 42 to the tank 43 at a set pressure when the piston 34 reaches the maximum tilt-up position.

A compression side relief valve 75 is connected to the second shuttle chamber 73B of the shuttle selector valve 70. The compression side relief valve 75 feeds, back to the tank 43, an amount of oil equivalent to the volume of a part of the piston rod 33 that is idle during the tilt-down operation and the trim-down operation, or releases the hydraulic oil pumped through the port 62B by the gear pump 42 to the tank 43 at the set pressure when trim-down is completed.

The marine vessel propulsion machine 10 constantly supplies the cylinder chamber 32 of the cylinder device 21 with the hydraulic oil discharged by the first discharge unit 42A, one of the two discharge units 42A and 42B of the gear pump 42. However, the marine vessel propulsion machine 10 has the switching unit 80 for switching between a case where the hydraulic oil discharged by the second discharge unit 42B is fed to the cylinder chamber 32 of the cylinder device 21 (tilt-up and tilt-down) and, a case where the hydraulic oil discharged by the second discharge unit 42B is not fed to the cylinder chamber 32 of the cylinder device 21 (trim-up and trim-down).

Figure 5:
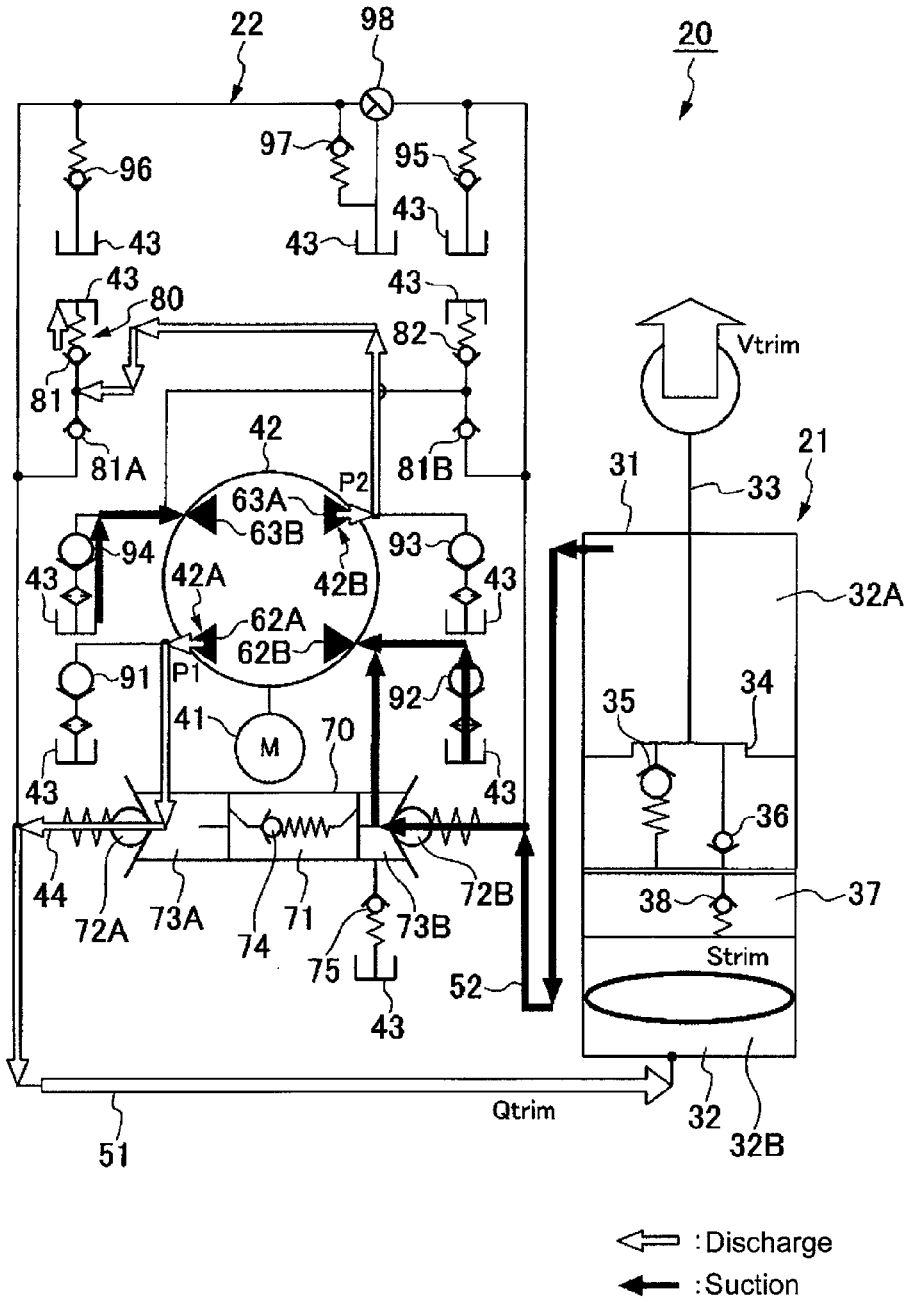
FIG. 5 is a circuit diagram showing a trim-up operation of the trim and tilt apparatus for the marine vessel propulsion machine.
Figure 6:
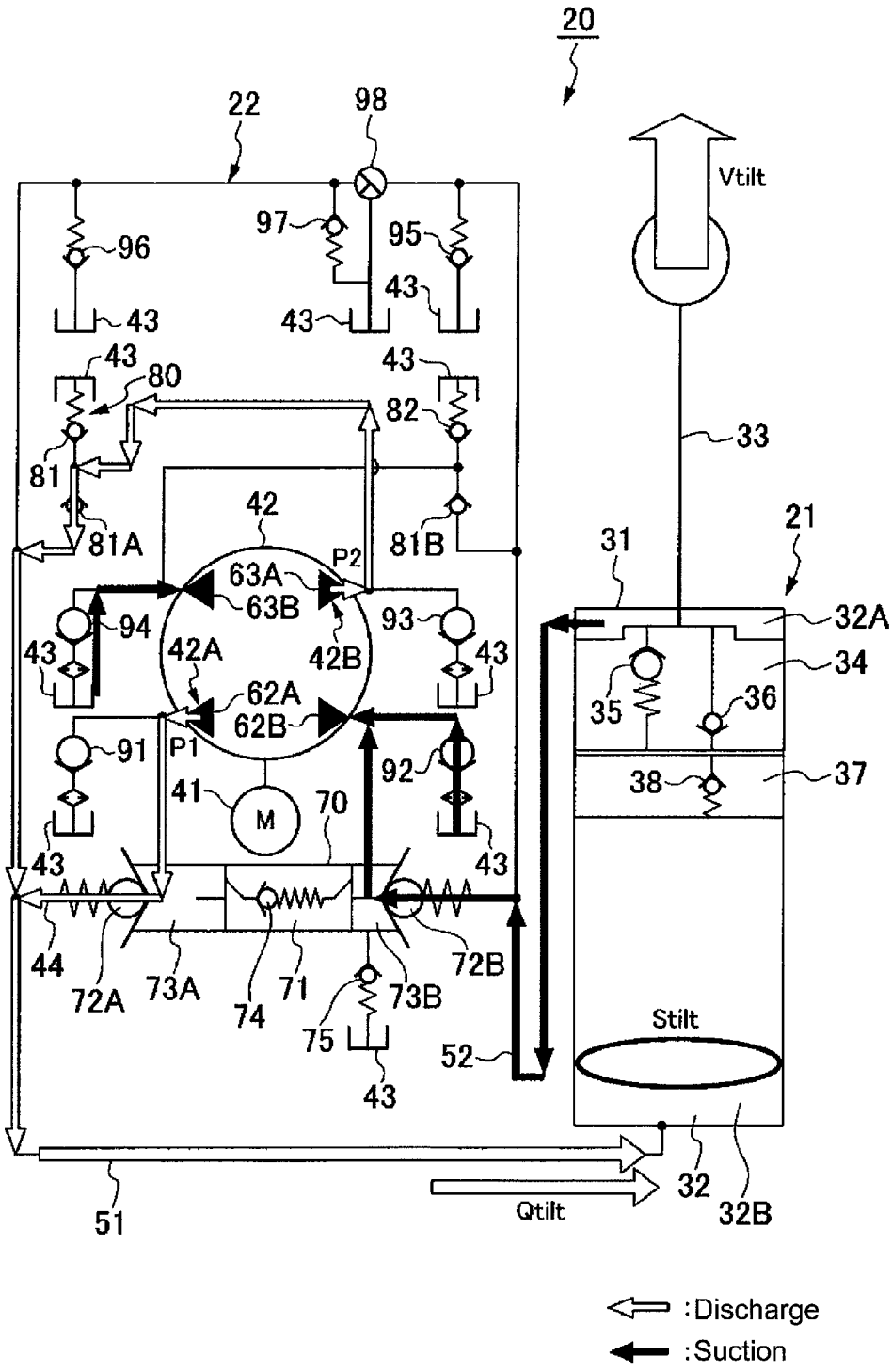
FIG. 6 is a circuit diagram showing a tilt-up operation of the trim and tilt apparatus for the marine vessel propulsion machine.

The switching unit 80 includes a trim-up relief valve 81 connected to the port 63A of the gear pump 42 and a trim-down relief valve 82 connected to the port 63B of the gear pump 42. The switching unit 80 operates as described below (FIG. 5 and FIG. 6). In FIG. 5 and FIG. 6, blank arrows show flows of discharged oil, and filled arrows show, flows of sucked oil.

(A) Trim-Up to Tilt-Up

When the marine vessel propulsion machine 10 performs a trim-up operation, the weight of and a forward propulsion by the propulsion unit 15 act on the piston rod 33, and as a result, a load greater than the weight of the propulsion unit 15 is applied to the piston rod 33. Then, as shown in FIG. 5, the trim-up relief valve 81 is opened to allow the hydraulic oil discharged through the port 63A by the above-described second discharge unit 42B, a part of the gear pump 42, as a result of the normal rotation of the gear pump 42, to be released to the tank 43 at a specific set pressure or higher, and avoids feeding the hydraulic oil to the second cylinder chamber 32B of the cylinder device 21. At this time, the pressure in the first channel 51 is increased by an amount equivalent to the forward propulsion by the propulsion unit 15, and the discharged oil from the port 63A fails to flow through the check valve 81A and pushes the trim-up relief valve 81 open. A discharged oil pressure P1 at the port 62A is higher than a discharged oil pressure P2 at the port 63A (P1>P2). Thus, in the marine vessel propulsion machine 10, only the hydraulic oil (oil amount Qtrim) discharged through the port 62A by the first discharge unit 42A, the remaining part of the gear pump 42, is fed from the first channel 51 to the second cylinder chamber 32B of the cylinder device 21 via the above-described shuttle selector valve 70. This allows the propulsion unit 15 to perform a trim-up operation at a low speed.

When the marine vessel propulsion machine 10 reaches the maximum trim-up position, the propulsion unit 15 emerges from under water. During a tilt-up operation after the marine vessel propulsion machine 10 thus reaches the maximum trim-up position, the propulsion unit 15 is located above the water and only the weight of the propulsion unit 15 is applied to the piston rod 33. This reduces the pressure in the first channel 51 to allow the above-described discharged oil from the port 63A of the second discharge unit 42B to flow through the check valve 81A, thus preventing the discharged oil from pushing the trim-up relief valve 81 open. The discharged oil pressure P1 at the port 62A is lower than the discharged oil pressure P2 at the port 63A (P1<P2). Thus, in the marine vessel propulsion machine 10, as shown in FIG. 6, the hydraulic oil (oil amount Qtilt) discharged by all of the discharge units 42A and 42B of the gear pump 42 through the ports 62A and 63A thereof is fed from the first channel 51 to the second cylinder chamber 32B of the cylinder device 21. This allows the propulsion unit 15 to perform a tilt-up operation at a high speed.

That is, the amount Qtrim of hydraulic oil supplied to the second cylinder chamber 32B of the cylinder device 21 during the trim-up operation of the marine vessel propulsion machine 10 is smaller than the amount Qtilt of hydraulic oil supplied to the second cylinder chamber 32B of the cylinder device 21 during the tilt-up operation. In this case, the cross-sectional area of the second cylinder chamber 32B of the cylinder device 21 is constant over a trim-up operation range (area Strim) to a tilt-up operation range (area Stilt). As a result, a resultant trim-up velocity Vtrim applied to the marine vessel propulsion machine 10 is lower than a tilt-up velocity Vtilt.

(B) Tilt-Down to Trim Down

Figure 7:
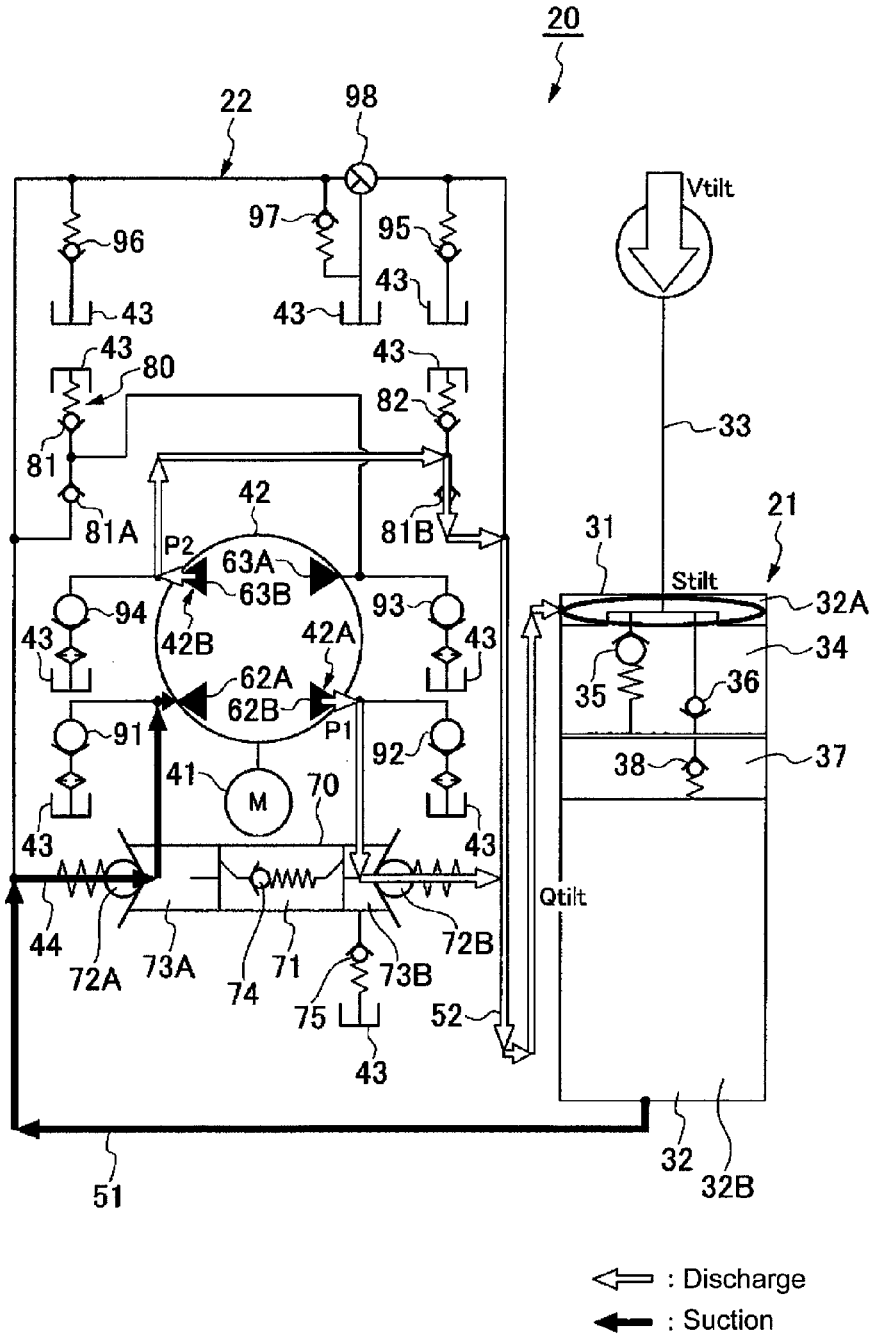
FIG. 7 is a circuit diagram showing a tilt-down operation of the trim and tilt apparatus for the marine vessel propulsion machine.

During a tilt-down operation from the maximum tilt-up position performed by the marine vessel propulsion machine 10, the propulsion unit 15 is located above the water, and the weight of the propulsion unit 15 pushes the piston rod 33 in a tilt-down direction to make the pressure in the second channel 52 negative. Thus, as shown in FIG. 7, the hydraulic oil discharged through the port 63B by the above-described second discharge unit 42B, a part of the gear pump 42, as a result of the reverse rotation of the gear pump 42, flows out to the second channel 52 through the check valve 81B and avoids pushing the trim-down relief valve 82 open. A discharged oil pressure P1 at the port 62B is lower than a discharged oil pressure P2 at the port 63B (P1<P2). Thus, in the marine vessel propulsion machine 10, the hydraulic oil (oil amount Qtilt) discharged by all of the discharge units 42A and 42B of the gear pump 42 through the ports 62B and 63B thereof is fed from the second channel 52 to the first cylinder chamber 32A of the cylinder device 21. This allows the propulsion unit 15 to perform a tilt-down operation at a high speed.

Figure 8:
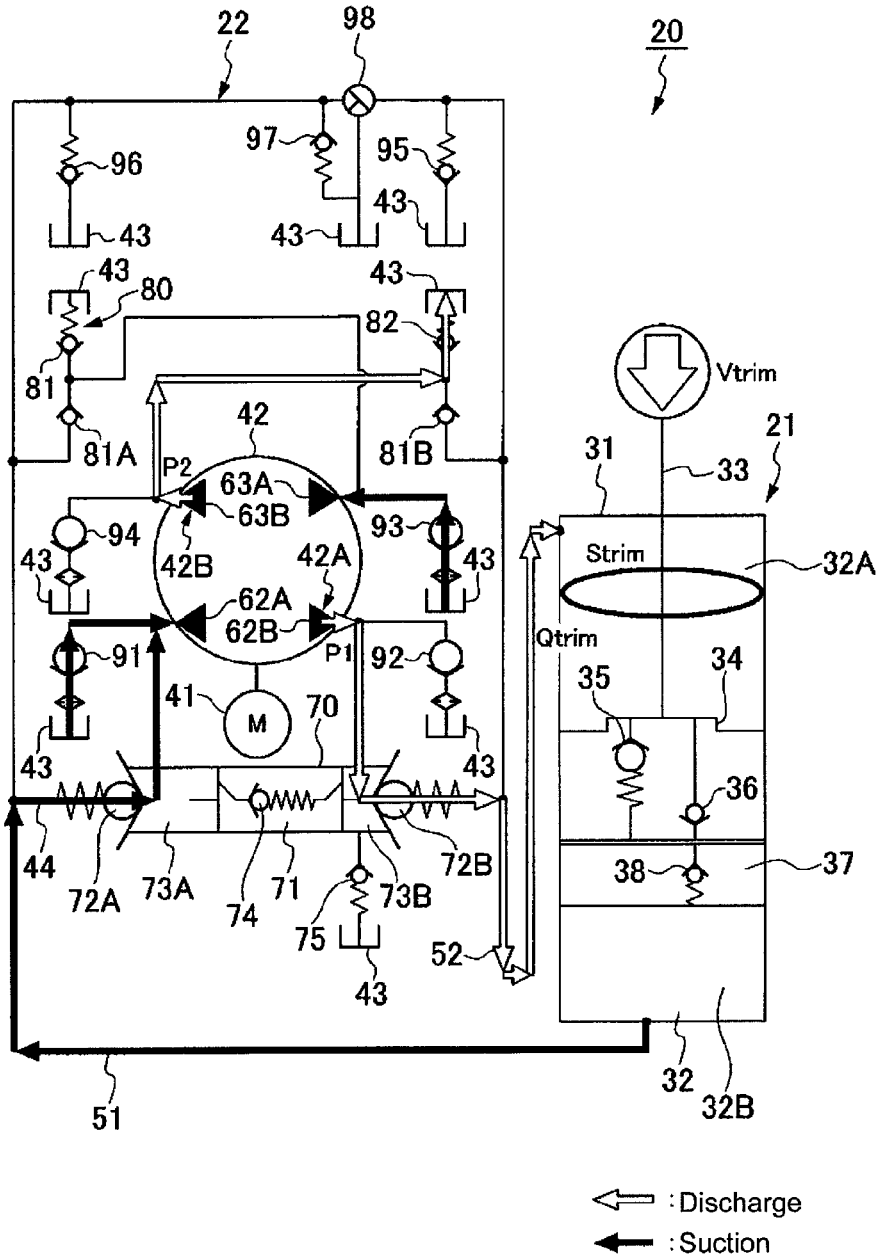
FIG. 8 is a circuit diagram showing a trim-down operation of the trim and tilt apparatus for the marine vessel propulsion machine.

During a trim-down operation after the marine vessel propulsion machine 10 reaches the maximum trim-up position, the propulsion unit 15 goes under the water, and resistance generated by a rearward propulsion and acting in an anti-trim-down direction acts on the piston rod 33 to increase the pressure in the second channel 52. Thus, as shown in FIG. 8, the hydraulic oil from the port 63B of the above-described second discharge unit 423 fails to pass through the check valve 81B and pushes the trim-down relief valve 82 open. The discharged oil pressure P1 at the port 62B is higher than the discharged oil pressure P2 at the port 63B (P1>P2). That is, the trim-down relief valve 82 is opened to allow the hydraulic oil discharged through the port 63B by the above-described second discharge unit 42B, a part of the gear pump 42, as a result of the reverse rotation of the gear pump 42, to be released to the tank 43 at a specific set pressure or higher, and avoids feeding the hydraulic oil to the first cylinder chamber 32A of the cylinder device 21. Thus, in the marine vessel propulsion machine 10, only the hydraulic oil (oil amount Qtrim) discharged through the port 623 by the first discharge unit 42A, the remaining part of the gear pump 42, is fed from the second channel 52 to the first cylinder chamber 32A of the cylinder device 21 via the above-described shuttle selector valve 70. This allows the propulsion unit 15 to perform a trim-down operation at a low speed.

That is, the amount Qtrim of hydraulic oil supplied to the first cylinder chamber 32A of the cylinder device 21 during the trim-down operation of the marine vessel propulsion machine 10 is smaller than the amount Qtilt of hydraulic oil supplied to the first cylinder chamber 32A of the cylinder device 21 during the tilt-down operation. In this case, the cross-sectional area of the first cylinder chamber 32A of the cylinder device 21 is constant over a tilt-down operation range (area Stilt) to a trim-down operation range (area Strim). As a result, a resultant trim-down velocity Vtrim applied to the marine vessel propulsion machine 10 is lower than a tilt-down velocity Vtilt.

The ports 62A, 62B, 63A, and 63B of the gear pump 42 are in communication with the tank 43 via check valves 91 to 94. That is, during the trim-up to tilt-up operation of the marine vessel propulsion machine 10, the internal volume of the cylinder chamber 32 of the cylinder device 21 increases by an amount equivalent to the withdrawal volume of the piston rod 33, leading to an insufficient amount of circulating hydraulic oil. Thus, the check valves 92 and 94 are opened to suck the hydraulic oil in the tank 43 into the gear pump 42, enabling the insufficiency of the circulating hydraulic oil to be compensated for. Furthermore, when the trim-down operation of the marine vessel propulsion machine 10 is completed and the feedback oil from the second cylinder chamber 32B to the gear pump 42 is exhausted, actuating the gear pump 42 opens the check valves 91 and 93 to enable the hydraulic oil to be fed from the tank 43 to the gear pump 42.

Furthermore, a relief valve 95 is connected to the first cylinder chamber 32A of the cylinder device 21 and is opened at a set pressure to enable the hydraulic oil in the tank 43 to be supplied to the first cylinder chamber 32A. A relief valve 96 is connected to the second cylinder chamber 32B of the cylinder device 21 and is opened at a set pressure to enable the hydraulic oil in the tank 43 to be supplied to the second cylinder chamber 32B. A relief valve 97 is connected to the second cylinder chamber 32B of the cylinder device 21 and is opened at a set pressure to enable the hydraulic oil in the tank 43 to be supplied to the second cylinder chamber 32B. A manual selector valve is denoted by 98 and makes the first channel 51 and the second channel 52 continuous with each other to allow the cylinder device 21 to be manually extended and contracted. This in turn allows the propulsion unit 15 to tilt freely within a trim range and a tilt range.

Thus, the present embodiment has the following effects.

(a) During the trim-up operation, the switching unit 80 avoids supplying the cylinder chamber 32 with the hydraulic oil discharged by one discharge unit 42B of the plurality of discharge units 42A and 42B of the hydraulic oil supply and discharge device 22, while supplying the cylinder chamber 32 of the cylinder device 21 with the hydraulic oil discharged by the remaining discharge unit 42A. On the other hand, during the tilt-up operation, the switching unit 80 also supplies the cylinder chamber 32 with the hydraulic oil discharged by one discharge unit 42B of the plurality of discharge units 42A and 42B of the hydraulic oil supply and discharge device 22, and as a result, supplies the cylinder chamber 32 of the cylinder device 21 with the hydraulic oil discharged by all of the plurality of discharge units 42A and 42B of the hydraulic oil supply and discharge device 22.

Thus, during the tilt-up operation, the cylinder chamber 32 is supplied with the hydraulic oil discharged by all of the discharge units 42A and 42B of the hydraulic oil supply and discharge device 22. This increases the flow rate of the hydraulic oil supplied to the cylinder chamber 32, with a resultant reduction in a tilt-up operation duration until the maximum tilt-up.

(b) Both the trim operation and the tilt operation are performed by moving only one piston 34 of the piston rod 33 through the cylinder chamber 32. The piston 34 having reached the maximum tilt-up position under the pressure of the hydraulic oil discharged by the pump 42 is retained at a stroke end in a tilt-up direction by the pressure of the hydraulic oil. Thus, at the end of tilt-up, the piston 34 can be retained in a tilt-up state without using piston push-up means such as spring force or gravity.

(c) The aspects (a) and (b) can be achieved by the simple trim and tilt apparatus 20 for the marine vessel propulsion machine including only one cylinder chamber 32 and one piston 34.

(d) During the trim-up operation, when the weight of and a forward propulsion by the marine vessel propulsion machine 10 are applied to the piston rod 33, a load greater than the weight of the marine vessel propulsion machine 10 is applied to the piston rod 33, and the cylinder chamber 32 of the cylinder device 2 is not supplied with the hydraulic oil discharged by one discharge unit 42B of the plurality of discharge units 42A and 42B of the hydraulic oil supply and discharge device 22 but only with the hydraulic oil discharged by the remaining discharge unit 42A. On the other hand, during the tilt-up operation, when only the weight of the marine vessel propulsion machine 10 is applied to the piston rod 33, the cylinder chamber 32 is also supplied with the hydraulic oil discharged by one discharge unit 42B of the plurality of discharge units 42A and 42B of the hydraulic oil supply and discharge device 22, and as a result, the cylinder chamber 32 is supplied with the hydraulic oil discharged by all of the plurality of discharge units 42A and 42B of the hydraulic oil supply and discharge device 22.

(e) The switching unit 80 includes the relief valve 81 that releases hydraulic oil of a specific pressure or higher which is discharged by one discharge unit 42B of the plurality of discharge units 42A and 42B of the hydraulic oil supply and discharge device 22 that simultaneously discharge the hydraulic oil. This simplifies the switching unit 80.

(f) The hydraulic oil supply and discharge device 22 includes the gear pump 42. This allows the hydraulic oil supply and discharge device 22 to be miniaturized.

(g) The gear pump 42 has two driven gears 62 and 63 that mesh with one drive gear 61. Thus, the single gear pump 42 allows the plurality of discharge units 42A and 42B to be provided.

The embodiment of the present invention has been described in detail. However, the specific configuration of the present invention is not limited to the embodiment, and any change or the like made to the design without departing from the spirits of the present invention is included in the present invention. For example, the plurality of discharge units included in the hydraulic oil supply and discharge device according to the embodiment of the present invention is not limited to the plurality of discharge units 42A and 42B provided in the single gear pump 42 but may be each of a plurality of independent pumps. Alternatively, the pump is not limited to the gear pump 42 but may be a vane pump.

Furthermore, the switching unit according to the embodiment of the present invention is not limited to the relief valve but may be a solenoid valve, an orifice, or the like.

Industrial Applicability

The embodiment of the present invention is a trim and tilt apparatus for a marine vessel propulsion machine including a cylinder with one cylinder chamber, a piston rod that is telescopically inserted into the cylinder chamber of the cylinder, and a hydraulic oil supply and discharge device that supplies and discharges hydraulic oil to and from the cylinder chamber of the cylinder, the trim and tilt apparatus allowing the marine vessel propulsion machine to perform a trim operation and a tilt operation, wherein the hydraulic oil supply and discharge device includes a plurality of discharge units for simultaneously discharging the hydraulic oil, and has a switching unit for switching between a case where the cylinder chamber of the cylinder is supplied with the hydraulic oil discharged by certain discharge unit(s) of the plurality of discharge units, and a case where the cylinder chamber of the cylinder is not supplied with the hydraulic oil discharged by the certain discharge unit(s). Thus, a trim and tilt apparatus for a marine vessel propulsion machine is provided which serves to reduce the tilt-up operation duration until the maximum tilt-up and which allows the piston to be retained at the maximum tilt-up position at the end of the tilt-up operation without using the piston push-up means.

Explanation of Reference Numerals

10 Marine vessel propulsion machine
20 Trim and tile apparatus
21 Cylinder device
22 Hydraulic oil supply and discharge device
31 Cylinder
32, 32A, 32B Cylinder chambers
33 Piston rod
42 Gear pump
42A First discharge unit
42B Second discharge unit
61 Drive gear
62, 63 Driven gears
80 Switching unit
81, 82 Relief valves

What is claimed is:

1. A trim and tilt apparatus for a marine vessel propulsion machine, comprising:

a cylinder with one cylinder chamber;

a piston rod that is telescopically inserted into the cylinder chamber of the cylinder; and a hydraulic oil supply and discharge device that supplies and discharges hydraulic oil to and from the cylinder chamber of the cylinder, the trim and tilt apparatus allowing the marine vessel propulsion machine to perform a trim operation and a tilt operation, wherein the hydraulic oil supply and discharge device comprises:

a plurality of discharge units for simultaneously discharging the hydraulic oil that is supplied to the one cylinder chamber; and a switching unit for switching between a case where the cylinder chamber of the cylinder is supplied with the hydraulic oil discharged by a part of the plurality of discharge units, and a case where the cylinder chamber of the cylinder is not supplied with the hydraulic oil discharged by the part of the plurality of discharge units.

2. The trim and tilt apparatus for a marine vessel propulsion machine according to claim 1, wherein when a load greater than a weight of the marine vessel propulsion machine is applied to the piston rod, the switching unit avoids supplying the cylinder chamber of the cylinder with the hydraulic oil discharged by the part of the plurality of discharge units, and supplies the cylinder chamber of the cylinder with the hydraulic oil discharged by a remaining part of the plurality of discharge units, and when only the weight of the marine vessel propulsion machine is applied to the piston rod, the switching unit supplies the cylinder chamber of the cylinder with the hydraulic oil discharged by all of the plurality of discharge units.

3. The trim and tilt apparatus for a marine vessel propulsion machine according to claim 1, wherein the switching unit comprises a relief valve that releases hydraulic oil of a predetermined pressure or higher which is discharged by a part of the plurality of discharge units for simultaneously discharging the hydraulic oil that are provided in the hydraulic oil supply and discharge device.

4. The trim and tilt apparatus for a marine vessel propulsion machine according to claim 2, wherein the switching unit comprises a relief valve that releases hydraulic oil of a predetermined pressure or higher which is discharged by a part of the plurality of discharge units for simultaneously discharging the hydraulic oil that are provided in the hydraulic oil supply and discharge device.

5. The trim and tilt apparatus for a marine vessel propulsion machine according to claim 1, wherein the hydraulic oil supply and discharge device comprises a gear pump.

6. The trim and tilt apparatus for a marine vessel propulsion machine according to claim 2, wherein the hydraulic oil supply and discharge device comprises a gear pump.

7. The trim and tilt apparatus for a marine vessel propulsion machine according to claim 3, wherein the hydraulic oil supply and discharge device comprises a gear pump.

8. The trim and tilt apparatus for a marine vessel propulsion machine according to claim 4, wherein the hydraulic oil supply and discharge device comprises a gear pump.

9. The trim and tilt apparatus for a marine vessel propulsion machine according to claim 5, wherein the gear pump has two driven gears that mesh with one drive gear.

10. The trim and tilt apparatus for a marine vessel propulsion machine according to claim 6, wherein the gear pump has two driven gears that mesh with one drive gear.

11. The trim and tilt apparatus for a marine vessel propulsion machine according to claim 7, wherein the gear pump has two driven gears that mesh with one drive gear.

12. The trim and tilt apparatus for a marine vessel propulsion machine according to claim 8, wherein the gear pump has two driven gears that mesh with one drive gear.

* * * * *